US005357649A

United States Patent [19]

Hasegawa et al.

[11] Patent Number: 5,357,649

[45] Date of Patent: Oct. 25, 1994

[54] NOZZLE FOR CARPET WASHER

[75] Inventors: Shuuichi Hasegawa; Shinichiro Takahashi; Kazushige Nozawa, all of Shizuoka, Japan

[73] Assignee: Amano Corporation, Yokohama, Japan

[21] Appl. No.: 53,408

[22] Filed: Apr. 28, 1993

[30] Foreign Application Priority Data

Apr. 30, 1992 [JP] Japan ..... 4-036168[U]

[51] Int. Cl.[5] ..... A47L 11/20

[52] U.S. Cl. ..... 15/320; 15/353; 15/415.1

[58] Field of Search ..... 15/321, 421, 320, 415.1

[56] References Cited

U.S. PATENT DOCUMENTS 2,988,459 6/1961 Buelow et al. ..... 15/421 X 3,939,527 2/1976 Jones ..... 15/321 X 4,353,145 10/1982 Woodford ..... 15/321

5,241,724 9/1993 Lim ..... 15/321 X 5,263,224 11/1993 Lovelady ..... 15/322 X

*Primary Examiner*—Chris K. Moore

*Attorney, Agent, or Firm*—Stevens, Davis, Miller & Mosher

[57] ABSTRACT

A nozzle for a carpet washer operated to travel on a carpet while supplying foam of a cleansing liquid onto a surface of a carpet under pressure of a pump and brushing the surface of the carpet by a washing brush, dirty water produced as a result of the brushing being drawn into a sewage tank through the nozzle, the improvement comprising an edge portion mounted on an inner surface of the nozzle in such a manner as to extend in a horizontal direction across the nozzle and to incline upwardly in a drawing direction of the dirty water.

1 Claim, 4 Drawing Sheets

NOZZLE FOR CARPET WASHER

BACKGROUND OF THE INVENTION

This Invention relates generally to a nozzle for a carpet washer in which a carpet is brushed bye washing brush while supplying foam of cleansing liquid to tile surface of the carpet, and dirty water (foam) produced as a result of washing is drawn into the nozzle so as to be recovered to a sewage tank, and more particularly to a structure of a dirty water drawing nozzle suitably used for a carpet washer.

In conventional dry foam type carpet washers, foam is beforehand prepared, and the surface of a carpet is brushed by a washing brush while dropping the foam onto the surface of the carpet in order to remove dirt from the pet. It is known that the conventional dry foam type carder washers have various kinds of structures as disclosed, for example, in Japanese Early Laid-Open Patent Publication Nos. Sho 57-142228, Sho 58-44025, Sho 58-83929, and Sho 60-34426. In those carpet washers, since the carpet is simply brushed while dropping foam onto the surface of the carpet, dirty foam (dirty water) is left on the surface of the carpet after washing, much time and labor Is required for removing it. Moreover, it takes a long time for drying the carpet.

In another carpet washer disclosed in Japanese Early Laid-Open Patent Publication No. Sho 58-61720, since there is provided an intake port (nozzle) for drawing dirty foam after washing in addition to the provision of a foam generator for generating foam and a rotary brush for brushing a carpet, there is the advantage that the time for drying the carpet after washing can be reduced by drawing the dirty water into the intake port after washing.

However, the nozzle for a carpet washer disclosed in the above Japanese Early Laid-Open Patent Publication No. Sho 58-61720 has the following Inconveniences. That is, since the intake port is of a horizontally-wide narrowly-spaced vertical type and dirty water (foam) is drawn into this intake port by suction force, the foam thus drawn is not fully recovered to the sewage tank, and is partly adhered to an inner wall surface of the nozzle due to surface tension. When the suction force is stopped, the adhered foam or dirty water begins to flow toward the Inlet port of the nozzle, thus eventually causing the surfaces of the carpet, floor, etc. to get wet.

SUMMARY OF THE INVENTION

It is therefore an object of the present invention to provide a nozzle for a carpet washer, in which foam or dirty water drawn into the nozzle is prevented from flowing back through its inlet port when a sucking operation of a blower is stopped.

According to the present invention, there is provided, in order to achieve the above objection, a nozzle for a carpet washer operated to travel on a carpet while supplying foam of a cleansing liquid to a surface of a carpet under pressure of a pump and brushing the surface of the carpet by a washing brush, dirty water produced as a result of the brushing being drawn into a sewage tank through the nozzle, the improvement comprising an edge portion mounted on an inner surface of the nozzle in such a manner as to extend in a horizontal direction across the nozzle and to incline upwardly in a drawing direction of the dirty water.

With a nozzle for a carpet washer of the present invention thus constructed, the foam or dirty water drawn into the passageway through the intake port of the nozzle collides against the edge portion projecting from the inner surface of the Intake passageway and pushes toward the center of the intake passageway, the quantity of the foam or dirty water adhering to the inner surface of the intake passageway due to surface tension thereby being reduced. Since the foam or dirty water is readily drawn toward the sewage tank carried by the suction air stream, it is efficiently drawn and recovered from the surface of the carpet. Even if the foam or dirty water somehow adheres to the inner surface, the edge portion prevent the foam or dirty water from flowing in a reverse direction. Therefore, the foam or dirty water can be prevented from flowing out through the inlet port of the nozzle after the stopping of the suction operation.

Preferably, the nozzle is formed of a combination of a pair of generally inverted-T-shaped shell halves. The shell halves are provided at inner surfaces thereof with each one of edge portions inclined upwardly in the drawing direction of the dirty water and extending in a horizontal direction across the shell halves in vertically spaced relation to each other.

Since the nozzle is constituted by a combination of a pair of shell halves, the edge portions can be easily formed on the inner surfaces of the shell halves respectively. Moreover, since the edge portions for preventing the foam or dirty water from flowing out are vertically spacedly on opposite inner surfaces of the nozzle, the generation of surface tension to opposite inner surfaces as well as the flow-out of the foam or dirty water can be prevented efficiently, thus enabling the carpet cleanly to be washed.

The above and other objects, novel features and advantages of the present invention will become more manifest to those skilled in the art from the following description taken in connection with the accompanying drawings.

DETAILED DESCRIPTION OF THE PREFERRED EMBODIMENT

One preferred embodiment of the present invention will be described hereinafter in derail with reference to the accompanying drawings.

Figure 1:
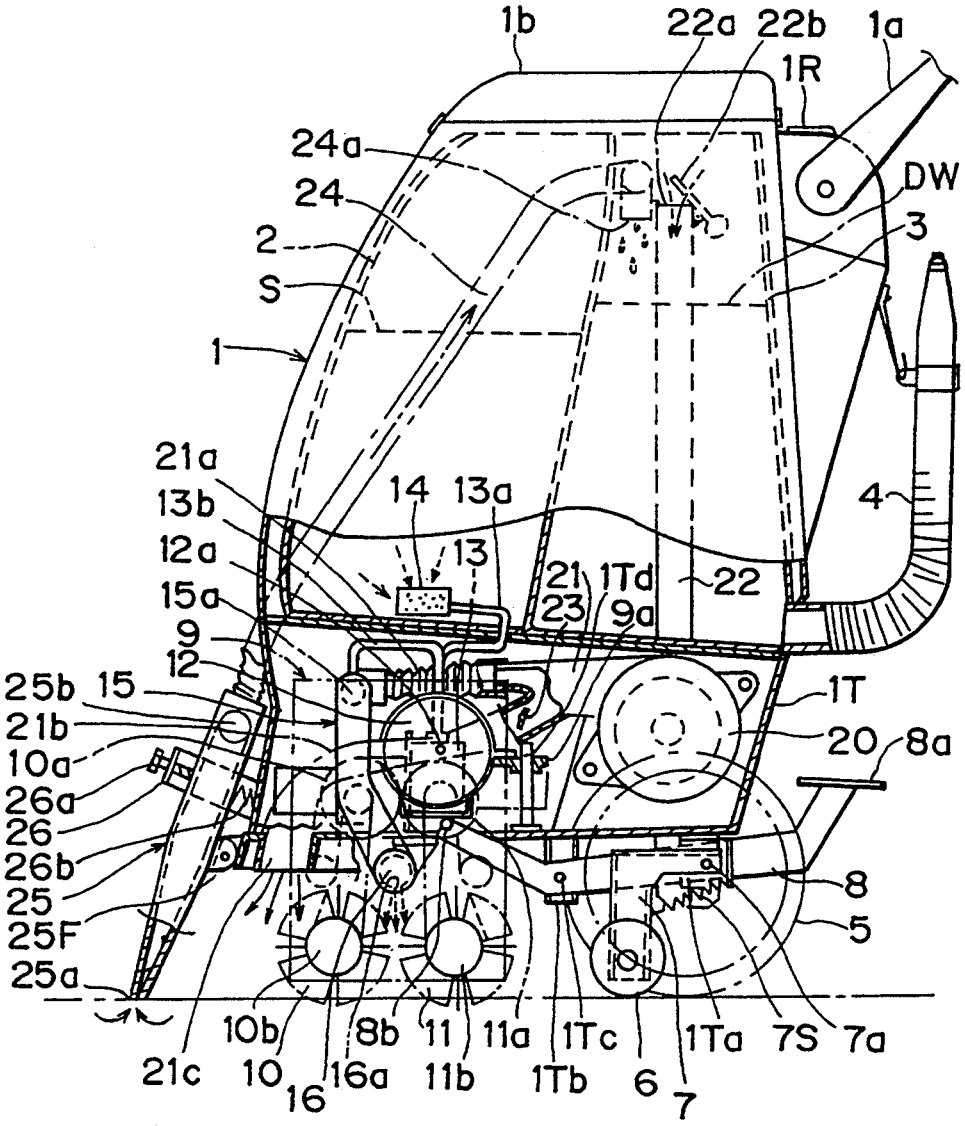
FIG. 1 is a side view, partly in section, showing a construction of a carpet washer having a nozzle according to one embodiment of tile present invention.
Figure 2:
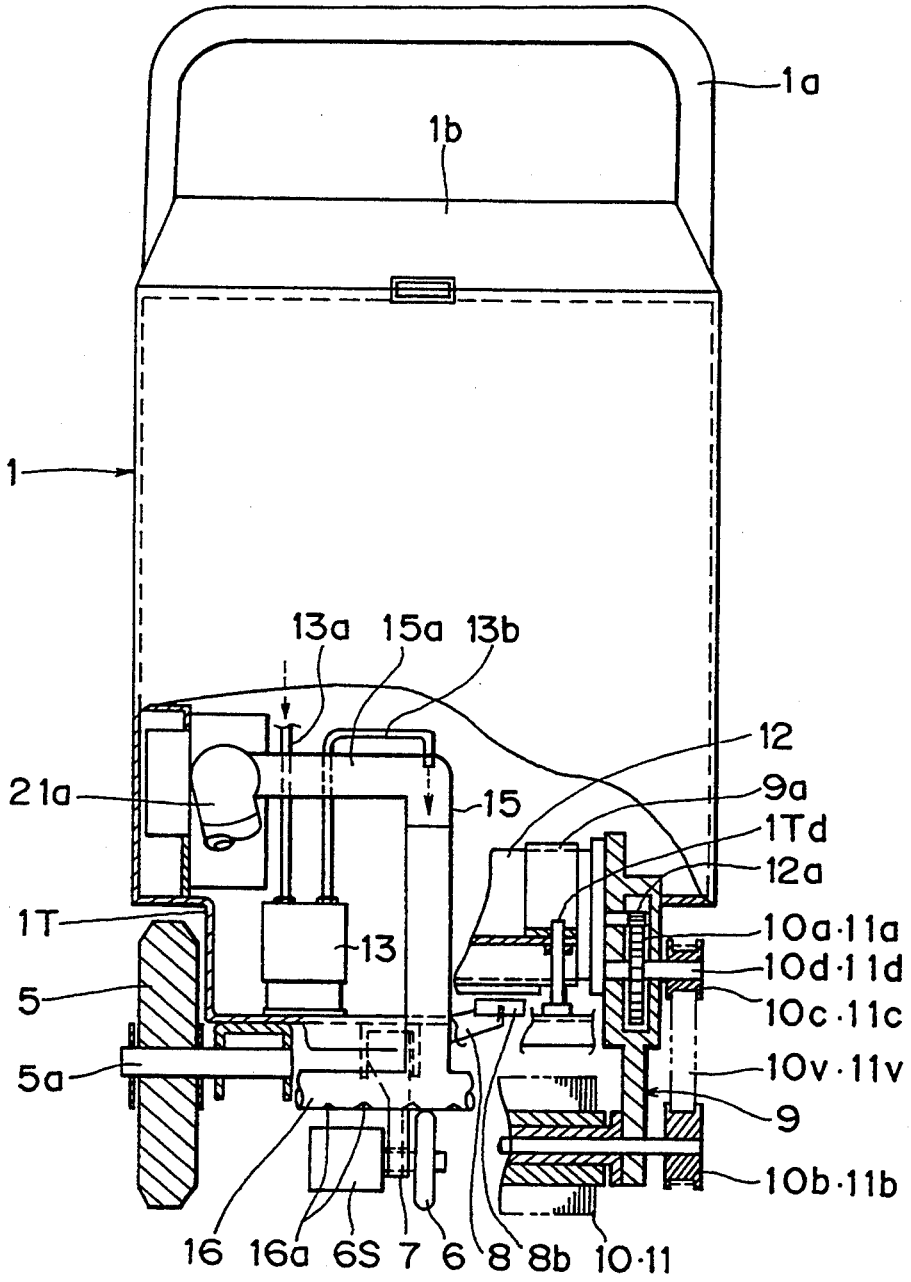
FIG. 2 is a front view, partly in section, of the carpet washer having the nozzle according to one embodiment of the present invention.

FIG. 1 shows a side view, partly in section, of a carpet washer incorporated with a nozzle according to one preferred embodiment of the present invention, and FIG. 2 shows a front view, partly in section, of the carpet washer of FIG. 1. In FIGS. 1 and 2, reference numeral 1 denotes a carpet washer body, reference numeral 2 denotes a tank for storing a cleansing liquid S, and reference 3 denotes a tank for storing a dirty water DW. The tanks 2 and 3 are accommodated within tile carpet washer body 1. Reference numeral 1*a* denotes a handle mounted on a rear part of the carpet washer body 1. Reference numeral 1*b* denotes a cover member covering upper surfaces of the tanks 2 and 3. Reference numeral 1T denotes a carpet washer body frame disposed at a bottom surface of the carpet washer body 1. Reference numeral 4 denotes a dirty water discharging hose attached to the sewage tank (dirty water tank) 3, and reference numeral 5 denotes a pair of wheels provided on opposite sides of the carpet washer body frame 1T. Reference numeral 1R denotes a display panel disposed at a rear part of the carpet washer body 1. The display panel 1R includes a display unit for displaying the speed of the carpet washer in a digital form such as, for example, a bar graph or the like, a power source ON/OFF display unit, a blower suction ON/OFF display unit, and a brush rotation ON/OFF display unit.

Reference numeral 5*a* denotes an axle with a pair of traveling wheels 5 and 5 mounted on opposite ends thereof, reference numeral 6 denotes a sensor wheel for detecting traveling speed of the carpet washer, and reference numeral 6S denotes a speed sensor. The sensor wheel 6 is mounted on a lower end portion of a swing arm 7 which is pivotally mounted at an upper end thereof on a bracket 1Ta extending downwardly from a bottom surface of the carpet washer body frame 1T through a pin 7*a* so as to be swung upwardly and downwardly. The sensor wheel 6 is located at an intermediate position between the pair of traveling wheels 5 and 5. The sensor wheel 6 normally contacts the surface of the carpet under a constant pressure by means of spring 7S which is mounted on tile swing arm 7, so that the traveling speed of the carpet washer is correctly transmitted to the speed sensor 6S to facilitate a correct measurement.

Reference numeral 8 denotes a foot lever pivotally mounted on a bracket 1Tb extending downwardly from a central portion of the carpet washer body frame 1T through a pin 1Tc such that the foot lever can be swung upwardly and downwardly. When a step plate 8*a* of the foot lever 8 is stepped down, a pressing pin 8*b* mounted on a distal end of the foot lever 8 raises a sheet plate 9 guided upwardly guided by four guide poles 1Td (only one guide pole is shown in FIGS. 1 and 2) and as a result, a washing brush, etc. mounted on the seat plate 9 can be raised upwardly.

Reference numerals 10 and 11 respectively denote a pair of washing brushes mounted on a lower side of the sheet plate 9 one at a front part and the other at a rear part thereof. These washing brushes 10 and 11 are relatively rotated by a motor 12 which is mounted likewise on sheet plate 9 through a stationary ring 9*a* so as to brush the surface of the carpet. More specifically, reference numerals 10*a* and 11*a* respectively denote operatively-connected gears engageable with a drive gear 12*a* of the motor 12 so as to be relatively rotated. Through belts 10V and 11V trained respectively around pulleys 10*c* and 11*c* mounted respectively on distal ends of rotary shafts 10*d* and 11*d* on which the gears 10*a* and 11*a* are respectively mounted, and pulleys 10*b* and 11*b* mounted respectively on rotary shafts of the washing brushes 10 and 11, the washing brushes 10 and 11 are relatively rotated to brush the surface of the carpet.

Reference numeral 13 denotes a pump likewise mounted on the sheet plate 9. An intake pipe 13*a* of this pump 13 is inserted into the cleansing liquid tank 2 so as to draw in the cleansing liquid S through a strainer 14. A feed pipe 13*b* of the pump 13 is connected to a foam generator 15 which is likewise mounted on the seat plate 9. The cleansing liquid S drawn in through the intake pipe 13*a* from the cleansing liquid tank 2 is supplied to the foam generator 15 through a feed port 15*a* to generate foam, and the foam thus generated is dropped onto the surface of the carpet from a discharge pipe 16 through a plurality of discharge holes 16*a*.

Reference numeral 20 denotes a blower mounted within the carpet washer body frame 1T. An intake pipe 22 of this blower 20 is erected upright with its inlet port 22*a* having a float valve 22*b* projecting upwardly within the sewage tank 3 so that the sewage tank 3 exhibits a drawing function. This drawing function is prevailed on a nozzle 25 mounted on a front surface portion of the carpet washer body 1 through an intake hose 24 whose distal end opening 24*a* is open within the sewage tank 3. A discharge duct 21 connected to a discharge port (outlet port) of the above blower 20 is forked at an intermediate portion thereof. One opening of the forked discharge duct 21 is connected to the foam generator 15 through a hose 21*a*, and the other opening provided at an inlet portion thereof with a flow rate regulating butterfly valve 23 is connected to an injection port 21*c* disposed between the nozzle 25 and the washing brush 10 through the hose 21*b*. The arrangement being such that a discharge air to be discharged from the blower 20 is sent to the foam generator 15 and the injection port 21*c* in order to generate foam and to dry tile surface of the carpet.

As shown in FIG. 1, tile nozzle 25 of the present invention, which is to be Incorporated in the carpet washer thus constructed, has an injection port 25*a* at a lower end thereof and a connecting port 25*b* at an upper end thereof, the connecting port 25 being connected to an inlet port of the intake hose 24. The nozzle 25 further has a support plate 25F projecting from an inner surface of a lower portion thereof. This support plate 25F is pivotally mounted on a front surface of the carpet washer body 1, and an upper potion of the nozzle 25 is clamped between an adjusting bolt 26*a* and a compression spring 26*b* mounted on a bracket 26 projecting forwardly from a front surface of the carpet washer body 1. Owing to this arrangement, the nozzle 25 is swingably mounted on the carpet washer body 1.

Figure 3:
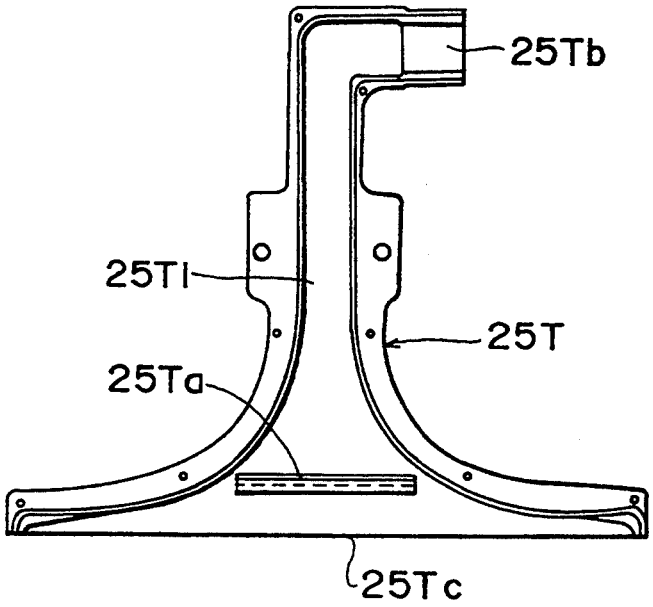
FIG. 3 is a front view of one of a pair of shell halves constituting tile nozzle of the present invention.
Figure 4:
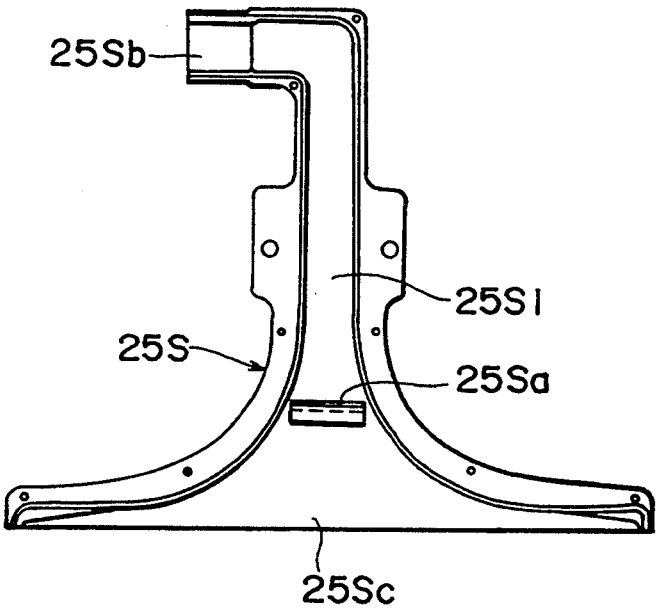
FIG. 4 is likewise a front view of the other of the pair of shell halves constituting the nozzle of the present invention.
Figure 5:
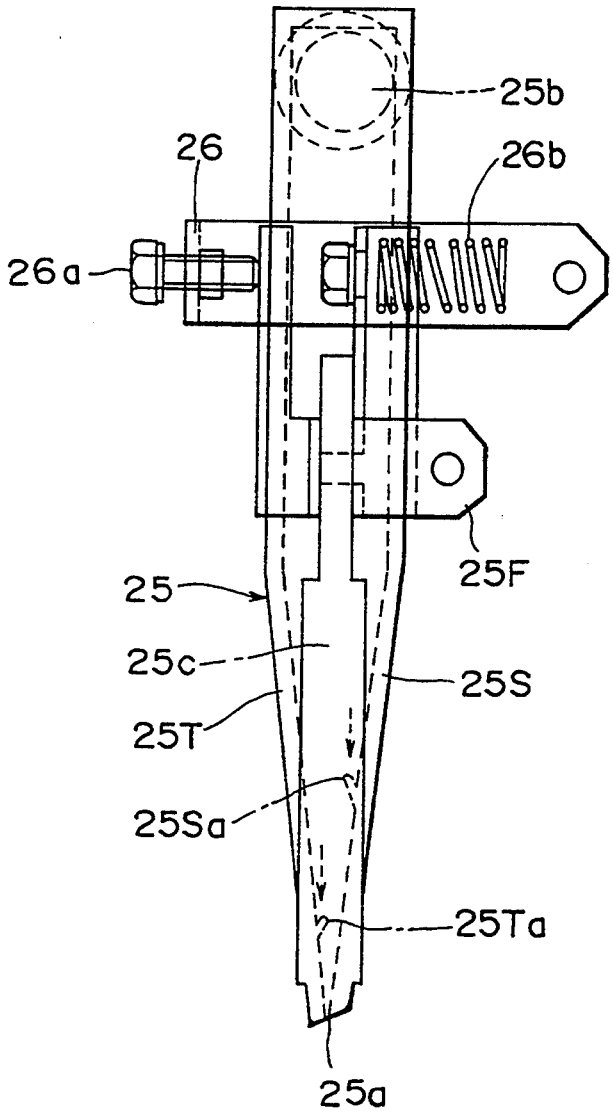
FIG. 5 is an enlarged side view of the nozzle of the present invention.

In FIGS. 3 and 4, reference numerals 25T and 25S respectively denote a pair of shell, halves constituting the nozzle 25 of the present invention. As shown in FIG. 5, a combination of these shell halves 25T and 25S each having a generally inverted-T-shape constitutes the nozzle 25 including the connecting port 25*b* formed at an upper end portion thereof by port portions 25Tb and 25Sb, a flat and horizontal intake port 25*a* formed at a bottom surface thereof by inlet ports 25Tc and 25Sc, and an intake passageway 25 formed therein by grooves 25T1 and 25S1.

The shell halves 25T and 25S are provided at inner surfaces thereof with each one of edge portions 25Ta and 25Sa inclined upwardly and extending in a horizontal direction across the shell halves 25T and 25S in vertically spaced relation to each other. The arrangement being such that when the shell halves 25T and 25S are combined, the edge portions 25Ta and 25Sa vertically spacedly project toward the intake passageway 25*c* from opposite sides thereof as shown in FIG. 5. Accordingly, the foam and dirty water hardly adhere to opposite inner wall surfaces of the nozzle, which would otherwise adhere thereto due to surface tension, and the adhered foam and dirty water hardly flow through the inlet port 25*a* when the suction force is stopped.

Since a nozzle for a carpet washer according to the present invention is constructed in the manner as mentioned above, when the carpet washer travels in the right-hand direction in FIG. 1 by pulling the handle la with a hand while rotating the wheels 5 and the washing brushes 10 and 11 after a starting switch is turned ON, the cleansing liquid S is sent into the foam generator 15 by the pump 13. Moreover, since the discharge air of the blower 20 is supplied to the foam generator 15 under pressurize, the cleansing liquid S to foam within the foam generator 15 to foam. This foam is rectified into a fine foam and then gradually dropped onto the surface of the carpet through the discharge holes 16*a* of the discharge pipe 16. Then, the surface of the carpet is brushed with the washing brushes 10 and 11 for cleaning.

Since a portion of the discharge air of the blower 20 is blown onto the surface of the carpet through the injection port 21*c* after brushing, the surface of the carpet wetted with the foam can be dried in a comparatively short time. Furthermore, since the suction force of the blower 20 prevails on the nozzle 25 through the pipe 22 and the hose 24, the dirty water (dirty foam) produced as the result of washing can be drawn from tile surface of tile carpet and recovered to the sewage tank 3.

Moreover, since the foam or dirty water drawn through the intake port 25*a* during the sucking operation of the nozzle 25 collides the edge portions 25Ta and 25Ts projecting upwardly at angles from opposite sides of the intake passageway 25*c* and guided to the center of the intake passageway 25*c*, the quantity of the foam or dirty water adhering to the inner surface of the intake passageway 25*c* can be reduced due to surface tension. Since the foam or dirty water is readily drawn toward the sewage tank 3 by the suction air stream of the blower 20, an excellent suction force is obtained. Moreover, the quantity of foam or dirty water flowing on the inner surface after the stopping the suction operation can be minimized. Even if the foam or dirty water somehow adheres to the inner surface and flows toward the intake port 25*a* after stopping the suction operation, tile foam or dirty water is received by the vertically spacedly projecting edge portions 25Ta and 25Sa which prevents further flow. Therefore, the problem had by the conventional device, of the foam or dirty water flowing through the intake port 25*a* of the nozzle 25 after stopping of the suction operation is solved.

As described in the foregoing, according to a nozzle for a carpet washer of the present invention, the surface of the carpet is brushed while supplying the foam of the cleansing liquid thereto, and the dirty foam is recovered to the sewage tank through the nozzle while drying the carpet by blowing the discharge air of the blower to the brushed surface of the carpet. More particularly, according to this invention, the foam or dirty water is prevented from flowing out after stopping the suction operation, there is no possibility that when the carpet washer is stopped, tile surface of the carpet and the floor under the nozzle get dirt. Therefore, the present invention is excellent in practical value when applied to a nozzle for a carpet washer.

While the present invention has been described above with respect to a single embodiment, it should of course be understood that tile present invention should not be limited only to the embodiment but various changes or modifications may be made without departing from the scope of the present invention as defined by the appended claims.

What is claimed is:

1. A nozzle for a carpet washer operated to travel on a carpet while supplying a cleansing liquid foam onto a surface of said carpet under pressure of a pump and brushing said surface of said carpet with a washing brush, dirty water produced as a result of said brushing being drawn into a sewage tank through said nozzle, said nozzle comprising a combination of a pair of generally inverted-T-shaped shell halves, each said shell half having an edge portion on an inner surface thereof with each one of said edge portions being inclined upwardly in the drawing direction of said dirty water and extending in a horizontal direction across said shell halves in vertically spaced relation to each other.

* * * * *